United States Patent [19]

DeLong

[11] Patent Number: 4,908,099

[45] Date of Patent: Mar. 13, 1990

[54] PROCESS TO DISSOCIATE AND EXTRACT THE LIGNIN AND THE XYLAN FROM THE PRIMARY WALL AND MIDDLE LAMELLA OR LIGNOCELLULOSIC MATERIAL WHICH RETAINS THE STRUCTURAL INTEGRITY OF THE FIBRE CORE

[76] Inventor: Edward A. DeLong, 439-22560 Wye Road, Sherwood Park, Alberta, Canada, T8A 4T6

[21] Appl. No.: 246,064

[22] Filed: Sep. 19, 1988

[51] Int. Cl.[4] ..... D21B 1/36

[52] U.S. Cl. ..... 162/21; 162/76; 162/77; 162/78; 162/89; 162/90

[58] Field of Search ..... 162/21, 22, 247, DIG. 5, 162/77, 90, 78, 76, 88, 89; 127/34, 37; 426/448, 447, 449, 426, 431, 439, 636, 653; 106/123.1, 163.1; 530/500

[56] References Cited

FOREIGN PATENT DOCUMENTS 2000822 1/1979 United Kingdom ..... 162/21

*Primary Examiner*—Steve Alvo

*Attorney, Agent, or Firm*—Griffin, Branigan & Butler

[57] ABSTRACT

A process for the separation of the fibres from each other in lignocellulosic (straw, bagasse, wood) composites, and at the same time to dissociate the Lignin and the Xylan in the middle lamella and the primary wall of the lignocellulosic material, to enable a simple non reactive solvent extraction of the middle lamella and primary wall components while substantially retaining the structural integrity of the fibre bundle, sometimes referred to as the S2 layer, which is the strength member of the lignocellulosic fibre. The purpose of this process is to produce a fibre suitable to replace conventional Chemical Thermal Mechanical Pulp, for paper or as a carrier for high absorbency Cellulose in diaper and similar absorbent material applications, and at the same time to recover the chemical components of the middle lamella and the primary wall of the fibre, as co-products in a marketable, chemically reactive form.

20 Claims, 2 Drawing Sheets

PROCESS TO DISSOCIATE AND EXTRACT THE LIGNIN AND THE XYLAN FROM THE PRIMARY WALL AND MIDDLE LAMELLA OR LIGNOCELLULOSIC MATERIAL WHICH RETAINS THE STRUCTURAL INTEGRITY OF THE FIBRE CORE

DESCRIPTION OF THE INVENTION

Until the invention of the process to render Lignin separable from Cellulose and Hemicellulose and the product so produced (Canadian Patent 1,217,765 and 1,141,376), there was no known economically viable process to cleanly sever the cross links between the chemically reactive Lignin and the Hemicellulose, which in turn permits their separation from the Cellulose in dissociated lignocellulosic material, by non reactive solvent extraction.

In this specification, "lignocellulosic material" includes such plant growth materials as bagasse, rice straw, wheat straw, oat straw, barley straw, and woods of various species. Lignocellulosic material is comprised of three main chemical components—Lignin, Hemicellulose and Cellulose—in the following approximate proportions, plus ash, oils and trace elements:

Hardwoods:

Lignin: 21%

Hemicellulose: 27%

Cellulose: 50%

Annual Plant Material (Straw, Bagasse, etc.)

Lignin: 15%

Hemicellulose: 35%

Cellulose: 48%

The Cellulose and Hemicellulose are both carbohydrates. Cellulose is nature's most abundant organic chemical, Lignin is second and Xylan is third. Cellulose is composed of six-carbon (glucose) sugar molecules connected together in a long chain. The Xylan component (approximately 70%) of the Hemicellulose is annuals and hardwoods is an amorphous carbohydrate polymer comprised mainly of five-carbon (Xylose) sugar molecules. The Lignin is a complex amorphous hydrocarbon molecule comprised of many of the chemical components found in oil and gas, such as phenol, benzene, propane, etc. The function of these three materials in the lignocellulosic complex is as follows:

The core of the lignocellulosic fibre is comprised primarily of Cellulose. Cellulose is the skeleton and the structural strength member in the fibre structure. It occurs as bundles of crystalline fibrils, which support the fabric of the tree or plant. This fibre core, sometimes referred to as the S2 layer, is made up of thousands of microfibrils of Cellulose which are hinged together in a long fibril chain. The hinges occur about every 300 glucose molecules within the Cellulose molecule. The fibrillar chain is bound together with other fibrils into a bundle by a thin layer of Lignin and Hemicellulose which is crosslinked to form a matrix. This matrix surrounds and protects the Cellulose fibrils in the fibre and holds the structure together in the manner of resin in a fibreglass composite.

It is this Lignin/Hemicellulose matrix which provides nature's protection against microbial invasion. It also renders the material water resistant and inaccessible to chemical reagents.

BRIEF DESCRIPTION OF THE DRAWINGS

FIG. 3 is a representation of a lignocellulosic fibre where the dotted area 46 is called the Middle Lamella. The Middle Lamella 46 is the glue which holds adjacent fibres together. It contains crosslinked lignin and xylan in a ratio of about 70 to 30. The Primary Wall 48 is the outer casing around the fibre core much like the casing on an underground telephone cable. It contains crosslinked lignin and xylan in about equal quantities with a small amount of cellulose to provide structural strength. The fibre bundle or core 50, 51 and 52 consists of closely bound cellulose fibrils. Each fibril is bound to the adjacent fibrils by a further coating of crosslinked lignin and xylan. The ratio of lignin to xylan in the fibre core is 30 to 70, but because of its large volume relative to the Middle Lamella and Primary Wall, 70 percent of the lignin is found in the fibre core. The fibrils in the fibre core form a slight spiral along the direction of the fibre and each fibril is hinged by an amorphous area about every 300 glucose molecules in the fibril. It is this hinge which is the weakest area in the fibril and is the point where fibrils are converted to microfibrils by the Explosion Process when operated at or above 234 degrees centigrade according to the teachings of Canadian Patent 1,217,765. Finally, the lumen 54 is a hollow area in the middle of the fibre bundle wh where liquids migrate through the lignocellulosic composite to provide nourishment to the plant.

Figure 3:
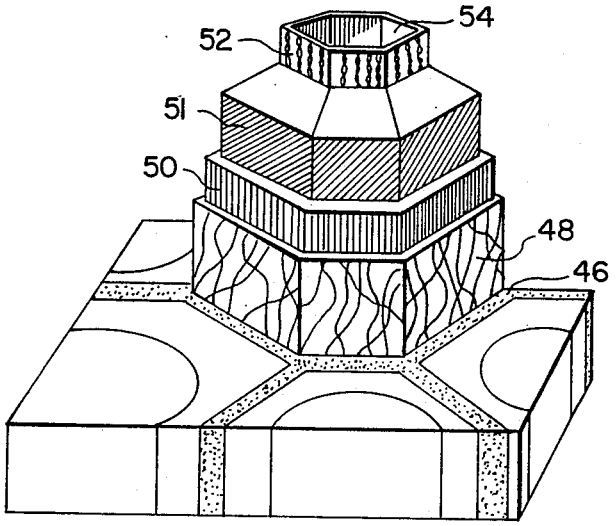
FIG. 3 is a representation of a lignocellulosic fiber.

To make a fibre suitable for paper, it is necessary to expose the Cellulose in the fibre core. Fibres are held together in the paper by hydrogen bonding which occurs between the Cellulose fibrils in the fibres. The fibres are often beaten mechanically to increase the Cellulose surface area and thus the available sites for hydrogen bonding to occur. Additives such as clay and cationic starch are also used in the production of paper. These small particle substances act as a filler and glue, in and around the interstices between the fibres in the paper mat. Thus, to produce an acceptable fibre, it is necessary to dissociate the Lignin/Hemicellulose crosslinks in the middle lamella and the primary wall of the fibre so that the lignin can be extracted from the fibrous material without destroying the structural integrity of the fibre core (See FIG. 3).

The main chemical components of the fibre, which are involved in the fibre matrix are the Lignin, which is an amorphous hydrocarbon polymer consisting of many of the chemical components of oil and gas such as phenol, benzene and propane, the Xylan which is an amorphous carbohydrate polymer consisting of xylose molecules and the Cellulose which is a crystalline long chain polymer of glucose molecules. The Lignin is a delicate, easily hydrolysed polymer which has a glass transition or melting temperature of about 125 degrees celsius. Its degradation temperature is about 195 degrees celcius. The Xylan is also a delicate and easily hydrolysed polymer which has a glass transition or melting temperature of about 165 degrees celcius and a degradation temperature of about 225 degrees celcius. Both of the above glass transition temperatures are reduced slightly in the presence of moisture. The Lignin and the Xylan are heavily crosslinked within the fibre bundle, in the primary wall and in the middle lamella. These crosslinks can be likened to spot welds which soften and become mechanically weakened above the glass transition temperature of the Xylan. However, though weakened they will not sever unless hydrolysed or shocked mechanically. The strength of the crosslinks, and thus the degree of mechanical stress required to sever the Lignin/Xylan crosslinks, decreases as the temperature of the lignocellulosic fibre is raised above 165 degrees celcius. When the lignin/xylan crosslinks are severed, the lignin becomes highly soluble in alcohol and mild caustic. If the lignin/xylan crosslinks are not severed, then the lignin is insoluble in these mild organic solvents. If the lignin/xylan crosslinks are only partially severed, then only that lignin which has been severed from the Xylan will be soluble.

The Cellulose on the other hand is crystalline and thus mechanically and chemically rugged. The Cellulose can be likened to steel rods bound together by a heavily crosslinked resin. The Cellulose has a glass transition or softening temperature of 234 degrees celcius and a degradation temperature of 260 degrees celcius. Neither of these temperatures is substantially affected by the presence of moisture because of the crystalline form of the Cellulose. Thus, at temperatures which will markedly weaken the Lignin/Xylan crosslinkages, the Cellulose retains its full structural strength.

Figure 1:
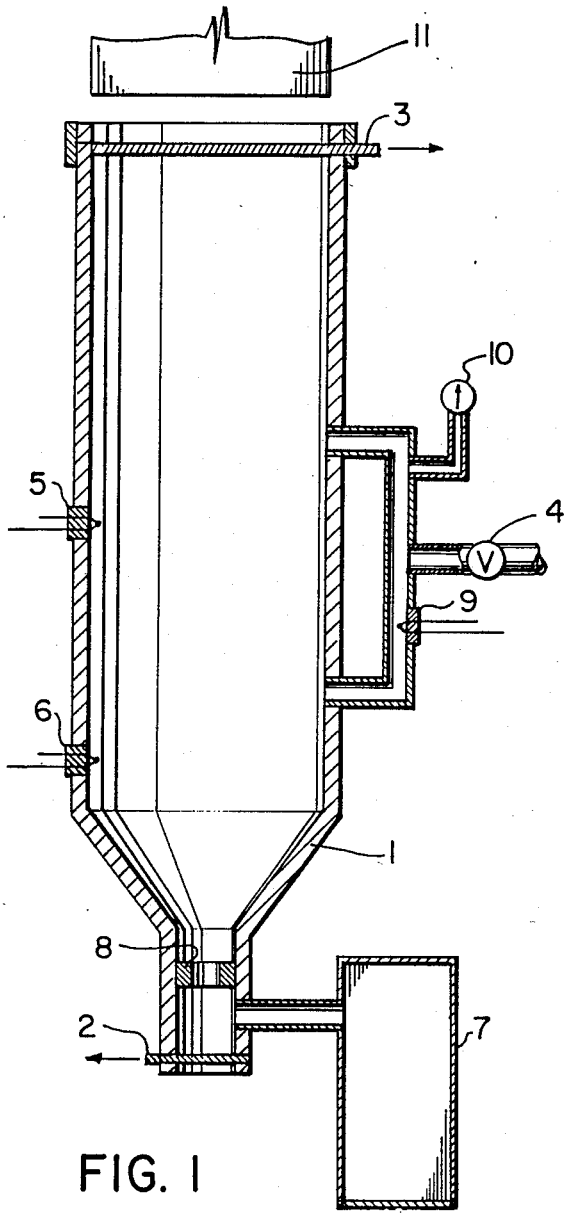
FIG. 1 is a sketch of an apparatus which is used to process the lignocellulosic material in this specification.

FIG. 1 is a sketch of an apparatus which is used to process the input lignocellulosic material in this specification. 1 is a pressure vessel having a valved outlet 2 at the base and a loading valve 3 at the top. 4 is the steam input valve. 5 and 6 are thermocouples designed to measure the temperature of the material in the pressure vessel. 9 is a thermocouple in the steam input line to measure the temperature of the input steam. 10 is a pressure gauge to measure the input steam pressure. 7 is a condensate trap to hold water condensate which is produced during the heating cycle of the material, when the hot steam is admixed with the much colder input lignocellulosic material. As the material draws heat from the steam, the condensate runs to the bottom of the digester and into the condensate trap 7. 8 is an optional die which can provide various orifice constrictions to provide more or less abrasion during explosive decompression dependent on the end application of the processed material. 11 is mechanically divided input lignocellulosic feedstock.

It is the objective of this invention to raise the temperature of the fibres within the lignocellulosic matrix to a temperature in the range of 160 degrees celcius to 185 degrees celcius, and then shock the Lignin/Xylan crosslinks by explosive decompression and abrasion to sever the Lignin/Xylan crosslinks which are outside the fibre core, while relying on the rigidity and structural strength of the Cellulose to maintain the integrity of the fibre core.

For a process such as this to be fully successful, it is essential that the dissociated Lignin from the middle lamella and primary wall be capable of substantially complete extraction from the fibrous material using mild non reactive organic solvents. If the extraction is not complete, then the residual Lignin leaves an amorphous coating on parts of the Cellulose which make up the fibre core. This coating will reduce the area available for hydrogen bonding. If the Lignin and Xylan fractions of the middle lamella and primary wall are not fully dissociated, then a strong caustic and heat treatment will be required to complete the extraction, as is done in the case of conventional Chemical Thermal Mechanical Pulping Systems. This treatment will also attack and degrade the structural integrity of the fibre core. Further, the bleach treatment of the residual fibres needs to be as mild as possible to prevent degradation of the fibres. The mildness of the required bleach cycle is dependent on the ability of the process to extract substantially all of the dissociated Lignin from the primary wall and the middle lamella using a mild solvent such as alcohol and less than one percent caustic.

To achieve complete dissociation of the Lignin and the Xylan components of the primary wall and the middle lamella while retaining the structural integrity of the fibre core, it is essential that the temperature rise within the wood composite must be homogeneous. That is, we need to ensure that all fibres are raised to a uniform temperature within the range 160 degrees celcius to 185 degrees celcius, preferably 175 degrees celcius. If some fibres are outside of this temperature range, particularly on the low side, then the fibres will not be properly treated with the result that complete Lignin/Xylan dissociation will not occur, and the Lignin and Xylan cell wall components will not extract without additional treatment.

To accomplish this, it is necessary to ensure that the heat transfer path, within the finely divided lignocellulosic input material, is substantially equal for all particle or chip sizes and straw lengths. For instance, the heat transfer path for straw is across its diameter and that is essentially equal for the full length of the straw. However, wood chips which are produced by a conventional butt end chipper are all different. It is therefore preferable to use a waferizer to commutate wood, because the thickness of the wood wafers is consistent from wafer to wafer and the heat transfer path is along the thickness dimension of the wafer.

The next important consideration is the moisture content of the lignocellulosic material. The higher the moisture content the more heat is consumed in raising the temperature of the material to the required process temperature. Further, the higher the moisture content, the more condensate which is generated within the reactor. If this condensate is not trapped out of the reactor on a continuous basis then part of the input material will be submerged in water and will not achieve the required temperature. Thus, it is essential that a condensate trap be installed as part of the reactor installation to drain off condensate as it is produced within the reactor. When low moisture content materials are being processed, it is necessary to reduce the temperature of the input steam to prevent pyrolysis. Lignocellulosic materials do not transfer heat efficiently. In fact, many of them are used as heat insulating materials. The lower the moisture content, the slower is the heat transfer. Indeed, it is possible to pyrolize and thereby degrade a low moisture content material such as straw, before even heating occurs throughout the stock of the straw. It has been found by extensive experimentation, that the optimum time to raise the temperature of the input material to the desired level is between 30 seconds and 60 seconds, preferably 45 seconds. At heating times in excess of 60 seconds, the Xylan begins to hydrolyse to furfural which cross links with the Lignin to form a pseudolignin. Pseudolignin is inert, difficult to extract and has limited market value.

It is important that the thermocouple in the reactor measure the temperature of the material, not the temperature of the input steam. Thus, a thermocouple system embedded in a good heat conducting material and housed in a well which has good contact with the surrounding input material is required.

It has been found that a moist material having an acceptably short heat transfer path, which is loaded into the reactor at room temperature, requires an input steam temperature of between 15 and 25 degrees celcius in excess of the desired process temperature to raise that material homogeneously to the required temperature in a time of 45 seconds, whereas a dry material such as straw requires an excess steam temperature of only five to fifteen degrees celcius, to achieve the desired process temperature in a time of 45 seconds.

If the input lignocellulosic material is frozen or is mixed with frozen water or snow, it should be preheated to eliminate the ice and snow before placing it in the reactor for processing to prevent uneven heating of the material.

According to the present invention, there is provided a method of preparing bleached Cellulose fibres comprising:

(a) packing the lignocellulosic material in a suitably divided, exposed, preferably moist form, having a uniformly short heat transfer path, in a pressure vessel having a valved outlet, which is configured and dimensioned to afford suitable mechanical working during the explosive discharge of the lignocellulosic material, when it achieves the required temperature.

(b) rapidly filling the pressure vessel with steam to a pressure of at least 130 psi to bring, by means of the pressurized steam, substantially all of the lignocellulosic material to a temperature in the range of 160 to 185 degrees celcius in less than 60 seconds and thermally soften and thereby mechanically weaken the crosslinks between the Lignin and the Xylan in the lignocellulosic material.

(c) as soon as the lignocellulosic material has reached the desired process temperature, it is explosively released to atmosphere through the valved outlet, usually, but not necessarily, into a cyclone or blow pit. This explosive decompression reduces the pressure in the pressure vessel to atmosphere from a reactor pressure of at least 130 psi. The material issues from the restricted orifice in a fibrous form which consists of intact fibre cores and dissociated Lignin and Xylan mainly from the middle lamella and the primary wall. The dissociated Hemicellulose components are soluble in water and the Lignin fraction is soluble in alcohol or a mild, less than one percent solution of caustic at room temperature. The most usual pressure for freshly harvested moist wood or bagasse is in the range of 160 psi to 225 psi dependent on moisture content, length of the heat transfer path and the starting temperature of the input feedstock.

The pressure vessel is preferably rapidly filled with the said steam at a temperature which will bring the lignocellulosic material to a temperature in the order of 160 degrees celcius to 185 degrees celcius, more specifically to a temperature of the order of 175 degrees Celcius in about 45 seconds.

During the explosive expulsion from the reactor, the material is mechanically stressed by the explosive decompression and by abrasion which occurs within the valved outlet, in the closed pipe leading from the orifice to the cyclone and within the cyclone. This mechanical energy fractures the softened and mechanically weakened Lignin/Xylan crosslinks in the primary wall and the middle lamella. However, because the Cellulose is well below its glass transition temperature, it retains its structural rigidity and prevents fracturing of the Lignin/Xylan crosslinks which are encapsulated and thereby protected from mechanical shock within the fibre core.

(d) Water extracting the fibrous material to separate the water soluble lignin and hemicellulose components such as acetic acid, vanillin, syringaldehyde, furfuraldehyde, protein and water soluble xylose oligomers.

(e) Extracting the dissociated fraction of the Lignin from the residual mixture using a mild organic solvent such as Ethanol, Methanol, Isopropanol or a weak less than 1 percent caustic solution, using a caustic selected from the group sodium hydroxide, ammonium hydroxide or potassium hydroxide. If an alcohol is used the Xylan oligomers will be left in the fibrous material to improve the bonding characteristics for paper applications. The alcohol extraction may be followed by a mild, less than one percent, caustic extraction to remove the residual xylan oligomers.

(f) Bleaching the cellulosic fibre core residue to extract any residual colour and to further purify the fibres, then (g) Solvent exchanging the bleach with water or alcohol or water then Acetic Acid. In the case of both the alcohol, and the Acetic Acid, the pulp drying process is made more energy efficient but more importantly, both the alcohol and the Acetic Acid inhibit hydrogen bonding and thereby retain reactivity during drying. The Acetic Acid, in addition to inhibiting hydrogen bonding when drying the fibres, acidifies the fibres, which inhibits colour reversion of the bleached fibres on drying. Acetic acid produces the best result and may be more desireable than alcohol, because it is one of the co-products which is recovered from the water soluble extraction at the front end of the process.

Figure 2:
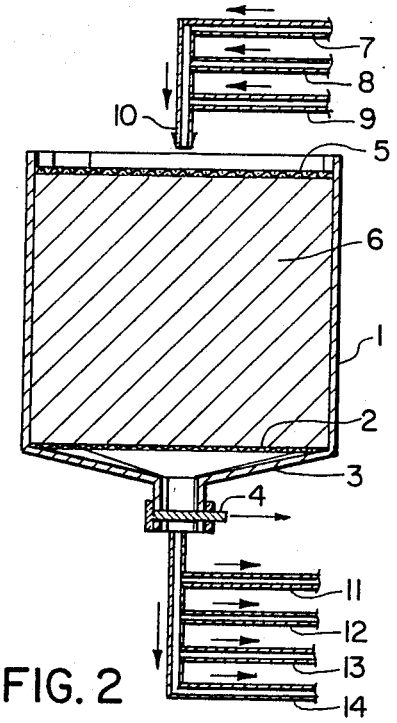
FIG. 2 is a sketch of a column used to achieve a first stage separation.

A preferred method of solvent extracting and bleaching the fibrous material, although conventional pulp washers, filters and bleaching equipment can be used, is in a column containing the fibrous material. FIG. 2 is a sketch of a column, which is used to dissolve and thereby achieve a first stage separation of the various dissociated chemical components of the Explosion Processed lignocellulosic material. The column 1 is a tube open at both ends. The tube can be almost any geometric configuration in cross section from circular to triangular to rectangular and so on. The column 1 is loaded with loosely packed processed lignocellulosic material 6. At the base of the column is a filter 2 which is fine enough to prevent the processed material from passing through, yet course enough to allow dissolved solids laden eluant to flow through as fast as the column of material will permit. The column is mounted on a reducing base 3 to bring the eluant to a neck with a valved outlet 4 to control the flow rate of the column when necessary. Temperature, pH, flow rate and other sensors are mounted in the column base to provide control information to the column Command and Control System. A fine screen 5 is mounted in the top of the column to disperse the input solvent evenly over the material at the top of the column. This prevents undue compression of the material in the column. The various solvents such as water 7, and alcohol 8, and mild caustic 9, are poured through the materials in the column in a plug flow manner in the sequence water and alcohol or water and alcohol and caustic or water and caustic. After the alcohol or caustic extraction the residual fibres can be bleached in conventional bleaching systems or preferably bleached by passing bleach, usually buffered hypochlorite, at a strength of less than 2 percent, preferably 1 percent, through the material while it is still contained within the column. Eluants laden with solids, soluble in that particular solvent, will flow through the processed lignocellulosic material in a plug flow fashion and be collected for product recovery from the base of the column as water solubles 11, alcohol solubles 12, caustic solubles 13, and bleach solubles 14 or any combination thereof. The end result is a high brightness, white fibrous material which is suitable for inclusion in paper and in absorbent materials, such as diapers and the like, as a carrier for highly absorbent Cellulose and superabsorbent derivatives. If higher brightness is required the material can be further bleached with hydrogen peroxide. If it is to be dried for transport to a remotely located paper mill, it can be post bleach treated in the column with the alcohol or Acetic Acid treatments described above. If it is to be used on site or transported in a wet condition the bleach is displaced by water to quench the bleaching action and the material can be used as is. The column is also used in situations where homogeneous impregnation with a reagent or a liquid/liquid exchange is required.

Using this new process, it is possible to produce a mixture of fibres for paper and a highly crystalline but very pure Cellulose as a filler. Normally, fibres and fillers are produced separately. In the latest paper machines, these pulps are added at different points in the formation of the paper mat. If however, the reactors are sequenced to produce fibrous material according to this new process for one or more shots, then sequenced to produce material according to the optimum parameters for producing dissociated fibres as outlined in Canadian Patents 1,217,765 and 1,141,376, a mixture of the two forms of processed material can be produced together in any desired ratio. Mixing of the materials takes place in the cyclone and post reactor material handling system.

Extraction of the water, alcohol and caustic solubles can be done as a mixture, followed by bleaching and post bleach treatments. For instance, four reactor volumes of fibrous material could be produced along with one reactor volume of filler material, if the end product application is paper where a high percentage of fibrous material is required.

This new process functionally replaces Chemical Thermal Mechanical Pulp (CTMP). Thermal Mechanical Pulp systems use rotating discs to separate thermally softened fibres. The fibres are then extracted and bleached in a modified Kraft pulping system. The use of pulping chemicals to extract the lignin and hemicellulose components produces a block liquour containing chemical modifications of the native wood constituents.

The Explosion Process thermally dampens the lignin, xylan and other hemicellulose constituents at the instant of the explosion due to adiabatic expansion of the escaping steam. Thus, the lignin and the hemicellulose components can be extracted using non reactive solvents, and then further separated into valuable coproducts using conventional separation techniques such as liquid/liquid and liquid/solid solvent extraction, distillation and commercial chromatography technology. The sale of these coproducts and the absence of a large liquid waste disposal problem, markedly improves the economics of this new process over conventional CTMP processes.

What is claimed is:

1. A method of producing mechanically intact but separated lignocellulosic fibre cores comprising:

(a) packing lignocellulosic material having substantially uniform lengths of heat transfer paths and being in a moist form in a pressure vessel having a valved outlet, and (b) with the valve closed, rapidly filling the pressure vessel with steam at a pressure of at least 130 psi to bring, by means of the pressurized steam, substantially all of the lignocellulosic material to a temperature in the range of 160 to 175 degrees celcius in less than 60 seconds and, at a temperature within said range wherein lignin and xylan components of the lignocellulosic material are softened but cellulose components of the lignocellulosic material are not softened, opening the valved outlet and instantly and explosively expelling the lignocellulosic material from the pressure vessel to cause the thermally softened lignin xylan crosslinks in the middle lamella and primary wall to be fractured while retaining the full structural integrity of the cellulose in the fibre cores.

2. A method according to claim 1, wherein the valved outlet is configured and dimensioned to afford substantial mechanical working of the material as it is explosively discharged through the outlet.

3. A method according to claim 1 wherein the pressure vessel is rapidly filled with steam at a temperature which is sufficient to bring the lignocellulosic material to a uniform temperature of 160 to 175 degrees celsius in less than 45 seconds.

4. A method according to claim 1 wherein the pressure vessel is rapidly filled with steam at a temperature which is sufficient to bring the lignocellulosic material to a uniform temperature of 175 degrees celsius in less than 45 seconds.

5. A method according to claim 1 wherein the expelling of the lignocellulosic material to atmosphere is accomplished in milli-seconds.

6. A method according to claim 1 wherein water soluble cell wall components of the expelled lignocellulosic material are extracted with water.

7. A method according to claim 6 wherein the water solubles extraction step is followed by an alcohol extraction, using an alcohol selected from the group consisting of ethanol, methanol and isopropanol, to extract dissociated lignin components of the material.

8. A method according to claim 6 wherein the water solubles extraction step is followed by a caustic extraction, using a caustic selected from the group consisting of sodium hydroxide, ammonium hydroxide and potassium hydroxide, to extract both the lignin and xylan components of the cell wall.

9. A method according to claim 7 wherein the alcohol extraction is followed by a caustic extraction to remove higher DP lignin and xylan components from the material.

10. A method according to claim 7 wherein the extracted lignocellulosic material is bleached using a buffered hypochlorite bleach at a concentration of less than two percent whereafter the bleach is then removed from the material with water or alcohol to bring the pH of the material to near neutral.

11. A method according to claim 8 wherein the extracted lignocellulosic material is bleached using a buffered hypochlorite bleach at a concentration of less than two percent whereafter the bleach is then removed from the material with water or alcohol to bring the pH of the material to near neutral.

12. A method according to claim 9 wherein the extracted lignocellulosic material is bleached using a buffered hypochlorite bleach at a concentration of less than two percent whereafter the bleach is then removed from the material with water or alcohol to bring the pH of the material to near neutral.

13. A method according to claim 10 wherein the hypochlorite bleaching is followed by a second bleaching step using hydrogen peroxide.

14. A method according to claim 11 wherein the hypochlorite bleaching is followed by a second bleaching step using hydrogen peroxide.

15. A method according to claim 10 wherein the bleach is removed from the material with water, and thereafter the water is displaced with acetic acid to inhibit colour reversion and hydrogen bonding during drying.

16. A method according to claim 11 wherein the bleach is removed from the material with water, and thereafter the water is displaced with acetic acid to inhibit colour reversion and hydrogen bonding during drying.

17. A method according to claim 12 wherein the bleach is removed from the material with water, and thereafter the water is displaced with acetic acid to inhibit colour reversion and hydrogen bonding during drying.

18. A method of extracting and bleaching material processed in accordance with claim 1 using a column open at both ends in which the material is placed, by successively extracting components of the material with sequential passing of selected solvents through the column and then bleaching the extracted material by passing a bleach through the column.

19. The method of claim 1 in which condensate is removed, as it is formed, from the pressure vessel containing the lignocellulosic material, during the heating of such material.

20. A method according to claim 1 wherein the expelled lignocellulosic material is then mixed with lignocellulosic material expelled from a further pressure reactor and then extracting and bleaching the mixed material, using a column open at both ends in which the material is placed, by successively extracting components of the material with sequential passing of selected solvents through the column and then bleaching the extracted material by passing a bleach through the column.

* * * * *